US008500269B2

(12) United States Patent
Morita

(10) Patent No.: US 8,500,269 B2
(45) Date of Patent: Aug. 6, 2013

(54) IMAGE FORMING METHOD AND IMAGE FORMING APPARATUS FOR FORMING AN IMAGE ON AN INTERMEDIATE TRANSFER MEDIUM

(75) Inventor: Akira Morita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 213 days.

(21) Appl. No.: 12/967,995

(22) Filed: Dec. 14, 2010

(65) Prior Publication Data

US 2011/0141188 A1 Jun. 16, 2011

(30) Foreign Application Priority Data

Dec. 16, 2009 (JP) ..... 2009-285772

(51) Int. Cl.
*B41J 2/01* (2006.01)

(52) U.S. Cl.
USPC ..... 347/103; 347/20; 347/6

(58) Field of Classification Search
USPC ..... 347/6, 20, 101–103
See application file for complete search history.

(56) References Cited

U.S. PATENT DOCUMENTS 7,281,790 B2 10/2007 Mouri
7,645,019 B2 * 1/2010 Hirakawa ..... 347/21
7,780,286 B2 * 8/2010 Yahiro ..... 347/103

* cited by examiner

*Primary Examiner* — Juanita D Jackson
(74) *Attorney, Agent, or Firm* — Canon USA Inc. IP Division

(57) ABSTRACT

Disclosed is a recording method in which an image is first formed on an intermediate transfer medium by ejection of ink and is then transferred to a printing medium. The present invention solves a problem regarding insufficient transfer of the image to the printing medium, which is caused by roughness on a surface of the ink image formed on the intermediate transfer medium due to non-uniform application amounts of ink. A transferability improving agent is applied in a controlled manner to an ink image which has been formed on a transfer drum by application of ink. The transferability improving agent is applied in a larger amount to regions with a relatively small application amount of the ink as compared with regions with a relatively large application amount of the ink.

10 Claims, 5 Drawing Sheets

IMAGE FORMING METHOD AND IMAGE FORMING APPARATUS FOR FORMING AN IMAGE ON AN INTERMEDIATE TRANSFER MEDIUM

BACKGROUND OF THE INVENTION

1. Field of the Invention

The present invention relates to an image forming apparatus and an image forming method. More specifically, the present invention relates to an image forming apparatus and an image forming method of an intermediate transfer system in which an image is first formed on an intermediate transfer medium by an inkjet device and then transferred to a printing medium.

2. Description of the Related Art

Recording high quality images has been recently increasingly in demand in various fields regardless of the type of printing media while taking advantage of an inkjet recording system.

If, however, an image is formed on a printing medium to which ink is less permeable in the inkjet recording system, the formed image suffers from feathering, beading or bleeding, which may affect image quality. The printing medium suffers from problems, such as cockling, which is a ruffling phenomenon caused by water-based ink permeating the printing medium.

In order to overcome these problems, an intermediate transfer recording system has been proposed. In this recording system, an ink image is first formed on an intermediate transfer medium by application of ink in an inkjet recording system. The ink image formed on the intermediate transfer medium is then transferred to a printing medium. This recording system requires no rapid permeation and fixing of moisture content of the ink to the printing medium for the prevention of feathering, beading or bleeding and, therefore, the printing medium can be selected from among various options. Since most of liquid content of the ink constituting the ink image is removed before the ink image formed on the intermediate transfer medium is transferred to the printing medium, permeation of the liquid content into the printing medium is reduced. Also, occurrence of cockling is suppressed, thereby protecting the texture of the printing medium.

In the intermediate transfer recording system, the ink image formed on the intermediate transfer medium is pressed against the printing medium to cause the ink image to be transferred to the printing medium. If a printing medium with a coarse surface is used in the intermediate transfer recording system, there has been a problem of a "transfer residue." In particular, a part of the ink image remains on the intermediate transfer medium without being transferred to the printing medium because of incomplete contact between the ink image and the printing medium.

As an approach to solve this problem, U.S. Pat. No. 7,281,790 proposes a method in which a resin-containing supplementary liquid is applied to an ink image formed on an intermediate transfer medium before and the ink image having the supplementary liquid applied thereto is transferred to a printing medium.

In the method disclosed in U.S. Pat. No. 7,281,790, the supplementary liquid is applied in accordance with logical sum data obtained from a logical sum of binary format image data corresponding to ink of four colors. This means that the supplementary liquid is applied only portions to which the ink has been applied. If the ink image has both high-duty portions and low-duty portions, the supplementary liquid is applied in a large amount to the high-duty portions while in a small amount to the low-duty portions. Such an approach does not reduce roughness on the ink image and, therefore, transferability of the ink image may be insufficient. In order to achieve sufficient transferability, it is desirable to make thickness of the ink image uniform as much as possible.

SUMMARY OF THE INVENTION

The present invention provides an image forming apparatus and an image forming method capable of successfully transferring an ink image formed on an intermediate transfer medium to a printing medium.

In an aspect thereof, the present invention is an inkjet recording method which includes the steps of: forming an image by applying ink and a transferability improving agent to an intermediate transfer medium, the transferability improving agent improving transferability of the ink applied to the intermediate transfer medium; and transferring the image formed on the intermediate transfer medium to a printing medium. In the step of forming the image, the transferability improving agent is applied in a larger amount to regions with a relatively small application amount of the ink per unit area as compared with regions with a relatively large application amount of the ink per unit area.

In another aspect, the present invention is an inkjet recording method, which includes the steps of: forming an image by applying ink and a transferability improving agent to an intermediate transfer medium, the transferability improving agent improving transferability of the ink applied to the intermediate transfer medium; and transferring the image formed on the intermediate transfer medium to a printing medium. In the step of forming the image, the transferability improving agent is applied in accordance with an application amount determined in accordance with the application amount of the ink per unit area such that the total of the application amounts of the ink and the transferability improving agent per unit area might be constant.

According to the present invention, since roughness on the ink image is reduced through the application of the transferability improving agent, transferability of the image is improved. Thus, residual images on the intermediate transfer medium after the transfer process are reduced. With this, a high quality image can be transferred to the printing medium even if the ink image formed on the intermediate transfer medium has non-uniform application amounts of ink and thus has non-uniform thickness.

Further features of the present invention will become apparent from the following description of exemplary embodiments with reference to the attached drawings.

DESCRIPTION OF THE EMBODIMENTS

Hereinafter, an embodiment of the present invention will be described in detail with reference to the drawings.

1. Overview

The present invention increases transferability of an image and thereby reduces a transfer residue on an intermediate transfer medium by employing a transferability improving agent. The transferability improving agent is, for example, resin-containing transparent ink which improves transferability of the ink applied to the intermediate transfer medium. The present invention is characterized in that an application amount of the transferability improving agent is controlled in accordance with an application amount of the ink. In particular, the transferability improving agent is applied in a larger amount to regions with a relatively small application amount of the ink per unit area as compared with regions with a relatively large application amount of the ink per unit area. More suitably, the application amount of the transferability improving agent is determined in accordance with the application amount of the ink per unit area such that the total of the application amounts of the ink and the transferability improving agent per unit area might be constant.

Although there is no sufficient ground for the excellent transferability achieved by the above-described structure, the present inventors have made the following assumptions. FIG. 2 is a schematic sectional view illustrating an ink image formed on an intermediate transfer medium 101. The intermediate transfer medium 101 corresponds to a part of a transfer drum 1, which is an intermediate transfer medium illustrated in FIG. 1. In FIG. 2, an ink image 102 formed on the intermediate transfer medium 101 through the application of ink is illustrated schematically. Since the ink is non-uniformly applied to the intermediate transfer medium, the formed ink image 102 has non-uniform thickness (i.e., the ink image is rough) as illustrated in FIG. 2. In particular, regions with a larger application amount of ink are thick while regions with a smaller application amount of ink are thin.

Figure 2:
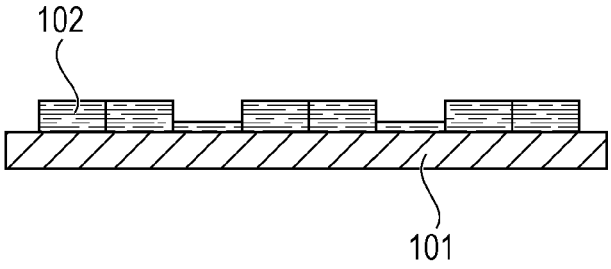
FIG. 2 is a schematic sectional view illustrating an ink image formed on an intermediate transfer medium.
Figure 3:
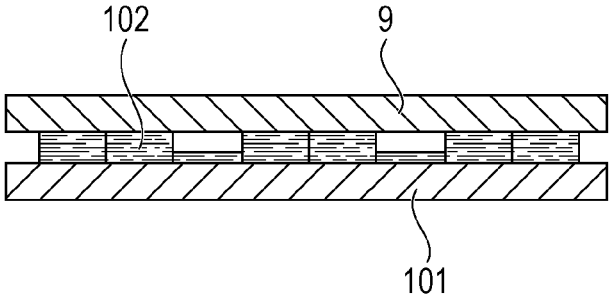
FIG. 3 is a schematic sectional view illustrating the ink image illustrated in FIG. 2 in contact with a printing medium.

FIG. 3 is a schematic sectional view illustrating the ink image 102 illustrated in FIG. 2 in contact with a printing medium 9 for the transfer of the ink image 102 to the printing medium 9. As illustrated in FIG. 3, if the ink image 102 formed on the intermediate transfer medium 101 has a high degree of roughness, thin (i.e., depressed) regions of the ink image 102 are difficult to come into contact with the printing medium 9 when the ink image 102 is brought into contact with the printing medium 9 for the transfer. The insufficient adhesion between the ink image 102 and the printing medium 9 may cause a transfer residue.

Figure 4:
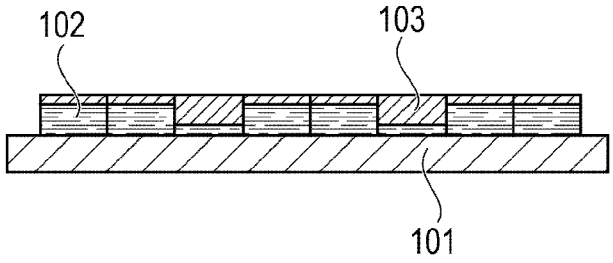
FIG. 4 is a schematic sectional view illustrating an image formed on the intermediate transfer medium constituted by ink and a transferability improving agent.

The present inventors have found that adopting the following configuration is very effective to reduce roughness on the image and to achieve more uniform image thickness so as to obtain sufficient adhesion between the ink image 102 and the printing medium 9 for the transfer. The present invention has been completed based on this knowledge. The present invention includes a configuration to control the application amount of the transferability improving agent in accordance with the application amount of the ink applied to the intermediate transfer medium. The application amount of the transferability improving agent 103 is controlled such that the transferability improving agent 103 might be applied in a larger amount to regions with a smaller application amount of the ink per unit area as compared with regions with a larger application amount of the ink per unit area as illustrated in FIG. 4. Thus, as is obvious from FIG. 4, roughness on the ink image is reduced as compared with the configuration illustrated in FIG. 2 having no transferability improving agent 103 applied thereto.

Figure 5:
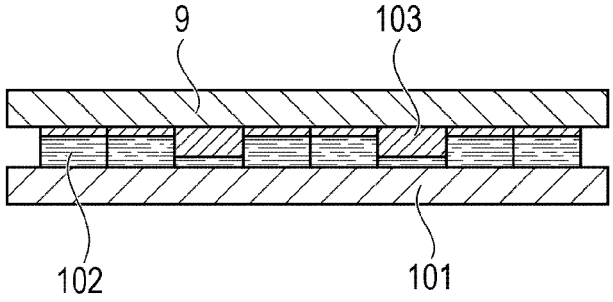
FIG. 5 is a schematic sectional view illustrating the image illustrated in FIG. 4 with the printing medium being in contact therewith.

In this manner, since the roughness on the ink image 102 is reduced by the controlled application of the transferability improving agent 103, regions which have not been brought into contact with the printing medium 103 without the application of the transferability improving agent 103 (i.e., depressed regions with a smaller application amount of the ink illustrated in FIG. 2) can be successfully brought into contact with the printing medium 9 with the applied transferability improving agent 103 as illustrated in FIG. 5. Thus, an increased contact area of the ink image 102 and the printing medium 9 improves adhesion of the ink image to the printing medium 9. As a result, transferability improves. Since thickness of the ink image is controlled to be substantially uniform, the ink image transferred to the printing medium 9 has improved smoothness. Thus, a resulted printed matter has improved glossiness.

2. Overall Structure of InkJet Recording Device

Figure 1:
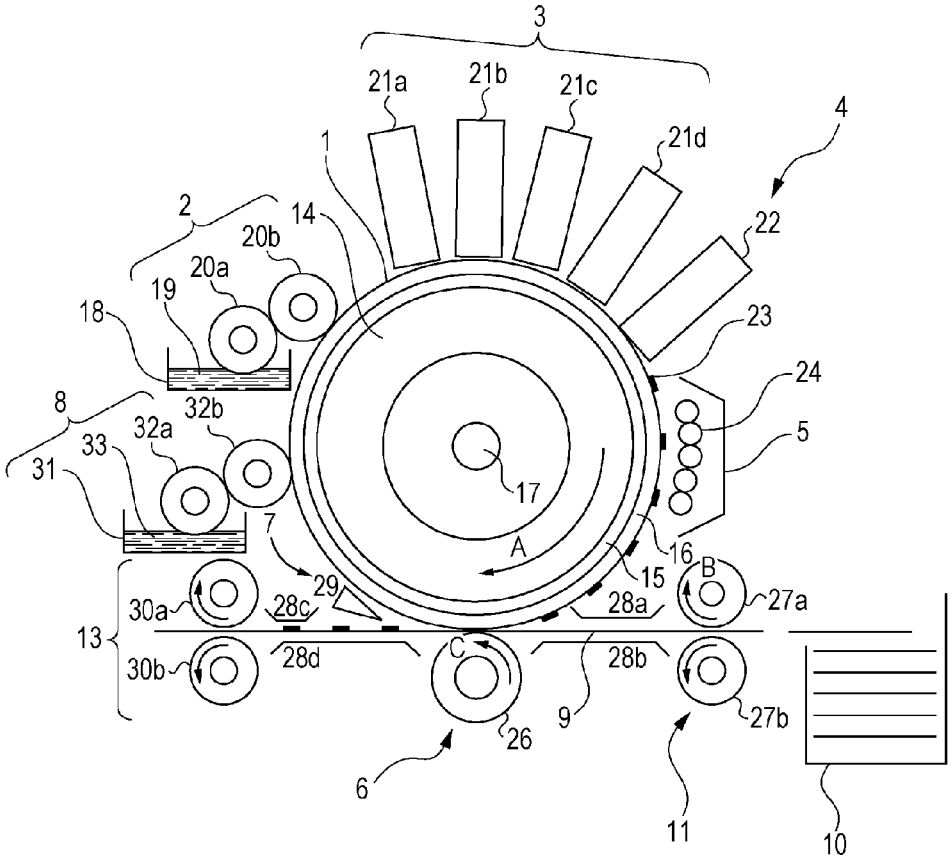
FIG. 1 illustrates a schematic structure of a main part of an inkjet recording device to which the present invention is applied.

FIG. 1 is a schematic sectional view illustrating a structure of a main part of an inkjet recording device according to an embodiment of the invention. In FIG. 1, the transfer drum 1 is an intermediate transfer medium which includes a surface layer having ink releasability. The transfer drum 1 is supported by a shaft 17 and can be driven to rotate in the direction of arrow A about the shaft 17 by an unillustrated drum driving unit. A process liquid application unit 2, an ink application unit 3, a transferability improving agent application unit 4, an ink image processing unit 5, a transfer unit 6, a printing medium separation unit 7 and a cleaning unit 8 are arranged in this order along the direction A opposing a circumference of the transfer drum 1.

The inkjet recording device also includes a paper feeding/conveyance unit 11 for conveying the printing medium 9 from a printing medium storage section (i.e., a paper cassette) 10 to the transfer unit 6. The inkjet recording device also includes a paper discharge/conveyance/fixation unit 13. After the ink image 23 formed on the transfer drum 1, which is the intermediate transfer medium, is transferred to the printing medium 9, the paper discharge/conveyance/fixation unit 13 fixes the ink image 23 to the printing medium 9 and then discharges the printing medium 9 to an unillustrated discharge tray.

Figure 6:
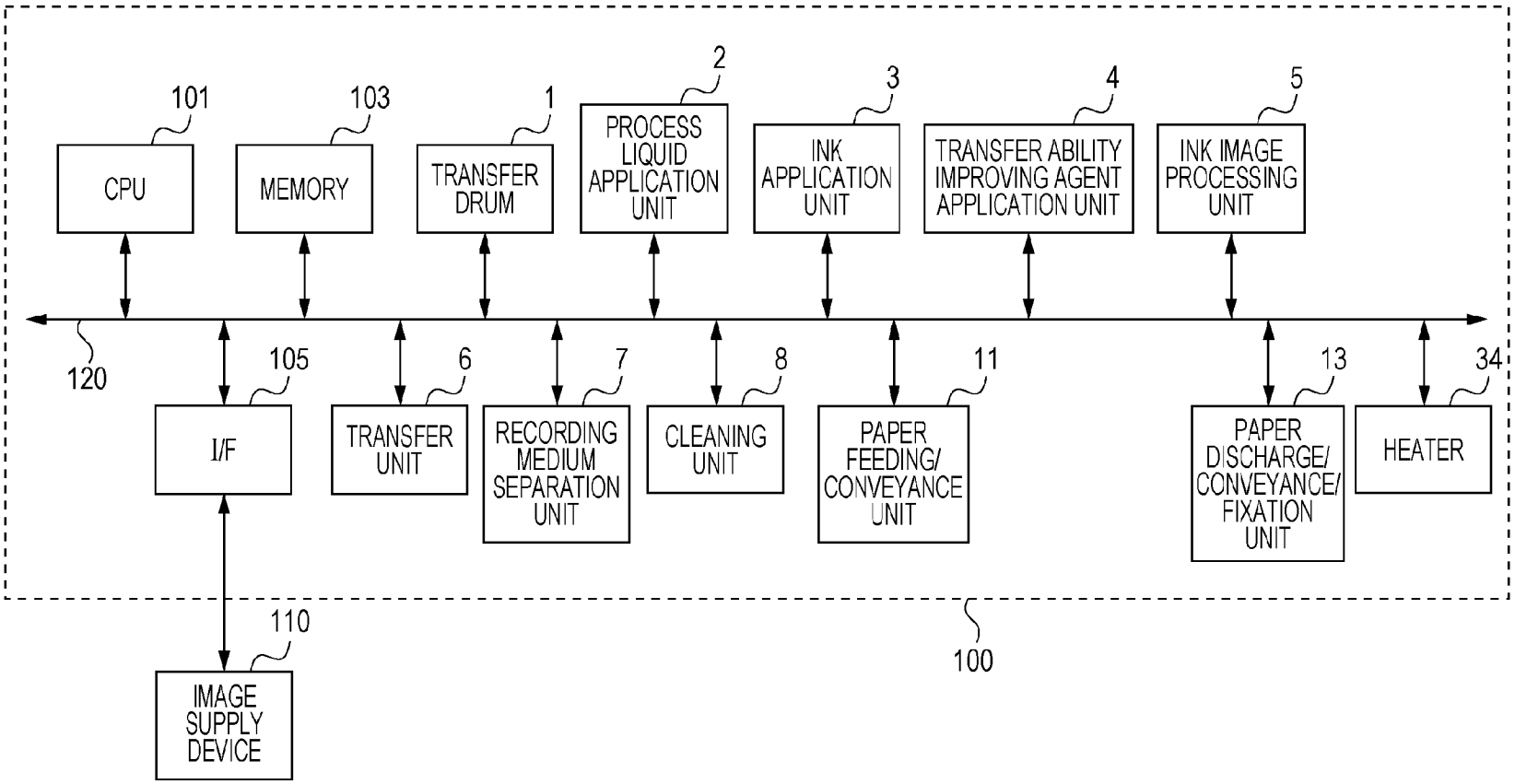
FIG. 6 is a schematic block diagram illustrating an exemplary structure of a control system of the inkjet recording device.

FIG. 6 is a schematic block diagram illustrating an exemplary structure of a control system of the inkjet recording device. In the inkjet recording device which is comprehensively denoted by a reference numeral 100, a CPU 101 executes control processing, data processing and other processing for the operation of the inkjet recording device. Memory 103 is a storage section which includes a ROM (not illustrated) in which computer programs of processing procedures are stored and a RAM (not illustrated) used as a work area for the execution of the processes. An I/F 105 is an interface for sending and receiving information, including data and commands between the inkjet recording device 100 and an image supply device 110. The image supply device 110 is a resource of image data and is, for example, a host computer.

In addition to those components described above, the transfer drum 1, the process liquid application unit 2, the ink application unit 3, the transferability improving agent application unit 4, the ink image processing unit 5, the transfer unit 6, the printing medium separation unit 7, the cleaning unit 8, the paper feeding/conveyance unit 11, the paper discharge/conveyance/fixation unit 13 and a heater 34 are connected to a bus line 120. The CPU 101 executes the required control while sending and receiving signals to/from each component via the bus line 120. Each component to be controlled is equipped with a status detection sensor and signals detected by the sensor are sent to the CPU 101 via the bus line 120.

The CPU 1 processes data in accordance with the computer programs stored in the ROM of the memory 103. For example, the CPU 1 generates image data corresponding to a mirror image by performing a mirror reversing process on the image data transmitted from the image supply device 110. The image data transmitted from the image supply device 110 may be binary image data, ternary image data or another multi-value image data. In the following description, however, the image supply device 110 transmits binary image data. Accordingly, the above-described image data corresponding to the mirror image is binary image data. The binary image data corresponding to the mirror image is stored in the RAM of the memory 103 as ink application data (binary data) corresponding to each color of ink.

Transferability improving agent application data used for the application of the transferability improving agent is generated on the basis of the above-described ink application data. In particular, the transferability improving agent application data is generated in accordance with the ink application data such that the transferability improving agent might be applied in a larger amount to regions with a smaller application amount of the ink per unit area as compared with regions with a larger application amount of the ink per unit area. The thus-generated transferability improving agent application data is stored in the RAM.

3. Details of Each Section 3.1 Transfer Drum

As illustrated in FIG. 1, the transfer drum 1, which is the intermediate transfer medium, has a layered structure: on an aluminum support 14, a compression layer 15 made of sponge rubber is formed; and surface layer 16 made of silicone rubber is formed on the compression layer 15. The material of the support 14 is not limited to aluminum. Any materials having stiffness to withstand pressure during the transfer, dimensional accuracy and characteristics required for the reduction in inertia of rotation and improvement in response to the control may be selected suitably. For example, the support 14 may be molded from metal, such as nickel and iron phosphate, high-strength thermosetting resin, such as acetal, and ceramic.

The sponge rubber for the compression layer 15 may be crude rubber, chloroprene rubber, ethylene propylene rubber, nitrile rubber or silicone rubber. For the compression layer 15, any materials having suitable elasticity to apply uniform pressure to the entire ink image during the transfer of the ink image 23 to the printing medium 9 and to absorb deviation of applied pressure may be employed.

The material of the surface layer 16 having ink releasability is not limited to silicone rubber. Any materials having suitable releasability and elasticity and sufficient transferability during the transfer of the ink image 23 to the printing medium 9 may be employed. The layer configuration may be changed suitably. "Releasability" herein is removability of the ink image 23 from the intermediate transfer medium surface without any sticking as described above. The higher the releasability, the more advantageous in respect of load during the cleaning and transferability of the ink.

The transfer drum 1 may also include a heater or other temperature control unit.

3.2 Process Liquid Application Unit 3.2.1 Configuration

The process liquid application unit 2 illustrated in FIG. 1 includes a process liquid vessel 18, a process liquid 19 and application rollers 20*a* and 20*b*. The process liquid application unit 2 is adapted to apply the process liquid 19 contained in the process liquid vessel 18 to the transfer drum 1.

The process liquid application unit 2 is disposed on the transfer drum 1 in the upstream of the ink application unit 3, which will be described later. The application roller 20*b* may be rotated following the rotation of the transfer drum 1 or may be driven to rotate in a controlled manner by a separately provided application roller driving unit (not illustrated). The application roller 20*a* may be rotated following the rotation of the application roller 20*b* or may be driven to rotate in a controlled manner by a separately provided application roller driving unit. As the two application rollers 20*a* and 20*b* are rotated, the process liquid 19 is applied to the surface of the transfer drum 1. Application thickness of the process liquid 19 to the transfer drum 1 is desirably in a range of 0.1 to 10 micrometers depending on the density of the process liquid 19. If the application thickness of the process liquid 19 is below 0.1 micrometers, non-uniform application may cause an uneven reaction of the process liquid and the ink. If the application thickness of the process liquid 19 is above 10 micrometers, aggregated ink moves on the surface of the process liquid 19, which may cause beading. Desirably, the application rollers 20*a* and 20*b* are made of a material with sufficient wettability with the process liquid 19. For example, porous materials, surface roughness materials and gravure roll materials may be used.

The method of applying the process liquid 19 is not limited to the roller coating. Alternatively, the process liquid 19 may be applied using a blade which controls the application amount, or may be applied using a spray or an inkjet recording head. With the inkjet application system, the process liquid 19 can be applied accurately to positions where the ink image 23 is to be formed. The process liquid application unit 2 can be controlled to be moved toward and away from the transfer drum 1 by an unillustrated toward and away movement control device.

3.2.2 Process Liquid

Here, the process liquid 19 applicable to the present embodiment will be described in detail. The process liquid 19 is a material which chemically reacts with or physically attracted to a colorant, resin or other components of the colored ink to thereby reduce flowability, i.e., increase viscosity, of the entire ink. The process liquid 19 causes aggregation of solid content (i.e., a colorant and resin) in the ink composition to thereby locally reduce flowability, i.e., increase viscosity. As described above, the process liquid 19 has a function to reduce flowability of the ink on the intermediate transfer medium when brought into contact with the ink to thereby hold ink droplets landing on the intermediate transfer medium to the landed positions as much as possible. With the process liquid 19, occurrence of beading or bleeding is prevented and a good image is formed even if the ink droplets come into contact with each other on the intermediate transfer medium.

The process liquid 19 is suitably selected from materials which cause aggregation of the ink composition upon contact with the ink. For example, liquid including metal salt is suitably used. The most suitable metal salt which constitutes the process liquid 19 is polyvalent metal salt. Polyvalent metal salt is constituted by bivalent or higher order polyvalent metal ions and anions coupling to the polyvalent metal ions. Materials which cause aggregation of the ink composition are not limited to metal salt. Other materials, such as those containing organic acid instead of metal salt, capable of reducing flowability of the ink may also be used. The process liquid 19 may also include a water-soluble organic solvent in addition to metal salt, such as polyvalent metal salt described above.

The process liquid 19 may also include water-soluble resin, a water-soluble crosslinking agent, an acid solution or other agents as an aggregation accelerator. Any materials capable of existing with polyvalent metal salt may be suitably used as the aggregation accelerator. The aggregation accelerators have relatively large molecular weight and therefore increase internal cohesive force of an image of aggregated ink when used with polyvalent metal salt. Thus, transfer efficiency of the ink image 23 to the printing medium 9 and rubfastness of the ink image 23 are improved.

Desirably, the process liquid 19 includes a surfactant for the purpose of uniform application thereof to the transfer drum 1. Various surfactants, such as a water-soluble anionic surfactant, a cationic surfactant, a nonionic surfactant and an amphoteric surfactant, may be used.

The process liquid 19 may also include other additives if necessary, such as a viscosity controlling agent, a pH adjusting agent, an antiseptic agent and an antioxidant. Although the process liquid 19 used in the present embodiment is desirably colorless, the process liquid 19 may be lightly colored unless it changes the color tone of colored ink when mixed with colored ink on the printing medium.

3.3 Ink Application Unit 3.3.1 Configuration

The ink application unit 3 applies, in accordance with image data, the colorant-containing ink to the transfer drum 1 to which the process liquid 19 has been applied by the process liquid application unit 2. The ink is applied by a recording head 21 which can control the application of the ink. Thus, the ink image 23 is formed on the transfer drum 1.

As illustrated in FIG. 1, the ink application unit 3 is disposed in the downstream of the process liquid application unit 2 on the transfer drum 1 and includes recording heads 21*a*, 21*b*, 21*c* and 21*d*. Hereinafter, the recording heads 21*a*, 21*b*, 21*c* and 21*d* will be collectively referred to as the recording head 21. In the inkjet recording device according to the present embodiment, the recording head 21 has an array of nozzles each of which includes an electrothermal converter (ejection heater). The electrothermal converter generates heat energy used for the ejection of the ink when energized. The electrothermal converter generates heat in accordance with image data, increases temperature of the ink and produces bubbles in the ink. The bubbles inflate to cause the ink to be ejected from the nozzles of the recording head 21. The recording head 21 used in the present embodiment is a linear head in which a plurality of nozzles for the ejection of the ink of the same color are arranged along the axial direction of the transfer drum 1 (i.e., the direction vertical to the paper of FIG. 1).

The configuration of the recording head 21 is not limited to the linear arrangement. A "serial" recording head may be adopted in which a plurality of nozzles for the ejection of the ink of the same color are arranged in a predetermined range along the circumferential direction or the axial direction of the transfer drum 1. With the serial recording head, images are formed sequentially on the transfer drum 1 while being scanned with recording head in the axial direction. With the serial recording head, the transfer drum 1 is driven to rotate intermittently. The transfer drum 1 is driven to rotate in a unit range, i.e., a range of the nozzle array or a range of use, along the circumferential direction of the recording head and then stopped upon serial scanning of the recording head. These driving and stopping are repeated alternately.

The ejection system of the inkjet recording head is not limited to the electrothermal converter. Any ejection systems, including a piezoelectric system, capable of ejecting the ink from the nozzle of the recording head may be employed. These alternative recording heads include configurations similar to that of the above-described recording head 21. It is obvious that variants similar to those described above can be adapted for the configurations and ejection systems.

The recording heads 21*a*, 21*b*, 21*c* and 21*d* are disposed at constant intervals in the circumferential direction of the transfer drum 1. The recording heads 21*a*, 21*b*, 21*c* and 21*d* are adapted to apply different colors to form a color image. In the configuration of FIG. 1, the recording heads 21*a*, 21*b*, 21*c* and 21*d* each apply the ink of black (K), cyan (C), magenta (M) and yellow (Y). However, the number of the inkjet recording heads which constitute the ink application unit 3, the sequence of the color of the ink to be ejected onto the transfer drum 1 and the hue of the ink in the present embodiment are not limited to those described above.

The ink image 23 formed on the transfer drum 1 must be a mirror image of the image finally formed on the printing medium 9 since it is reversed during the transfer. Accordingly, the image data supplied to the recording head 21 must correspond to the mirror image.

In the control system illustrated in FIG. 6, the binary image data corresponding to each ink color sent from image supply device 110 (i.e., image data corresponding to the image to be finally formed on the printing medium 9) is subject to a mirror reversing process to thereby generate binary image data corresponding to the mirror image. The binary image data corresponding to the mirror image is stored in the memory 103 as ink application data corresponding to each ink color. During the recording, the ink application data is read from the memory 103 and is supplied to the recording head 21.

3.3.2 Ink

The ink used in the ink application unit 3 is not especially limited and any commonly-used ink for inkjet recording may be employed. Pigment ink causes less breeding on the printing medium and has excellent water resistance and lightfastness as compared with dye ink. It is therefore desirable to adopt pigment ink including at least pigment as the colorant of the ink that may be suitably used in the present embodiment.

However, the ink is not limited to that using pigment ink as the colorant. Alternatively, dye ink or ink of dye/pigment mixture may also be employed. In the mixture, for example, known dye may be added to change the hue. If the process liquid 19 includes metal salt, the ink and/or the process liquid may include water-soluble resin, a crosslinking agent or other agents in order to increase internal cohesive force of the ink image 23.

3.4 Transferability Improving Agent Application Unit 3.4.1 Configuration

As illustrated in FIG. 1, the transferability improving agent application unit 4 includes a head 22 for applying the transferability improving agent. The applying transferability improving agent is applied to increase transferability of the ink image to the printing medium on the transfer drum. Desirably, the transferability improving agent is resin-containing transparent liquid ink. The head 22 for applying the transferability improving agent applies the transferability improving agent to the ink image formed through the application of the ink by the ink application unit 3. FIG. 4 is a schematic side view illustrating an exemplary ink image and an application pattern of the transferability improving agent according to the present embodiment. As is obvious from FIG. 4, the transferability improving agent is applied to the ink image such that difference in thickness of the entire ink image might be decreased (desirably, the ink image might have uniform thickness). In particular, the transferability improving agent is applied in a relatively small amount to regions with a larger application amount of the ink while in a relatively large amount to regions with a smaller application amount of the ink.

Next, control of the application amount of the transferability improving agent will be described. Here, a method of changing the application amount of the transferability improving agent in accordance with the application amount of the ink will be described.

First, the CPU 101 reads out binary ink application data corresponding to each ink color stored in the memory, and integrates, for each unit area (here, for each pixel), the read binary data of each color to obtain integration data. The read binary data is constituted by "0" representing not to eject the ink and "1" representing to eject the ink. Accordingly, the integration data obtained by the integration of the binary data of each color for each pixel represents the total number of the ink droplets applied to each pixel. The integration data provides the total amount of the ink applied to each pixel.

Then, the transferability improving agent data for the application of the transferability improving agent is generated such that the total of the application amounts (the number of droplets) of the ink and the transferability improving agent might correspond to the maximum value of the total of the application amount of the ink. For example, since the maximum value of the number of ink droplets applied to one pixel is four (each one droplet for the colors of CMYK), the data is generated such that one droplet of the transferability improving agent might be applied to the pixels with three droplets of the ink. Similarly, two droplets of the transferability improving agent might be applied to the pixels with two droplets of the ink and three droplets of the transferability improving agent might be applied to the pixels with one droplet of the ink. In this manner, the total of the application amount (i.e., the number of droplets) of the ink and the application amount (i.e., the number of droplets) of the transferability improving agent can be made constant (here, the total of four droplets). Thus, the image has reduced roughness and substantially uniform thickness.

In the above-described example, the total of the application amounts of the ink and the transferability improving agent might correspond to the maximum value of the total of the application amount of the ink. However, the total of the application amounts is not limited to the same. As another example, the transferability improving agent application data may be generated such that the total of the application amounts of the ink and the transferability improving agent might be a certain amount (e.g., six droplets) which is larger than the total of the maximum value of the application amount of the ink. In this case, since the maximum value of the number of ink droplets applied to one pixel is four, the data may be generated such that two, three, four or five droplets of the transferability improving agent might be added to the pixels with four, three, two or one droplet of the ink, respectively. In this example, the entire surface of the image is covered with the transferability improving agent.

With the thus-generated data, the amount of the transferability improving agent applied to regions with a relatively small application amount of the ink per unit area (e.g., a pixel) can be made larger than that applied to regions with a relatively large application amount of the ink per unit area.

In the data generation method described above, the application amount of the transfer material is determined in accordance with the binary ink application data. However, if the image data supplied from the image supply device is multi-value image data, it is also possible to determine the application amount of the transfer material on the basis of the multi-value image data. In that case, integration data is generated by the integration of the multi-value image data corresponding to each ink color for each pixel and difference between the value represented by the integration data and a constant value is obtained for each pixel. Here, the constant value is equal to or larger than the maximum value represented by the integration data. Then, let a value obtained by subtracting the value represented by the integration data from the constant value be multi-value transferability improving agent application data corresponding to the pixel. The multi-value transferability improving agent application data is binarized to provide the binary transferability improving agent application data. In this method, it is also possible to make the total of the application amounts of the ink and the transferability improving agent per unit area substantially constant.

In either approach of the binary data or the multilevel data, the transferability improving agent application data is generated such that the transferability improving agent might be applied in a smaller amount to regions with a relatively large application amount of the ink per unit area and applied in a larger amount to regions with a relatively small application amount of the ink per unit area. In accordance with the transferability improving agent application data, the transferability improving agent is applied to the ink image from the transferability improving agent application unit 4. In this manner, roughness on the image is reduced and transferability is improved.

As illustrated in FIG. 1, the linear head 22 for applying the transferability improving agent as the transferability improving agent application unit 4 is disposed in parallel with the recording heads 21*a*, 21*b*, 21*c* and 21*d* of the ink application unit 3 in the downstream of the ink application unit 3 along the circumferential direction of the transfer drum 1. Although the linear head is used as the head for applying the transferability improving agent in FIG. 1, a serial head may also be employed as in the recording head 21. A device provided in the nozzle of the recording head for applying the transferability improving agent may be an electrothermal converter or a piezoelectric element as in the recording head 21. Although the inkjet head is employed as the application unit of the transferability improving agent in the present embodiment, other units, such as a spray, capable of controlling the application amount of the transferability improving agent may alternatively be used.

In the present embodiment, the transferability improving agent application unit 4 is provided in the downstream of the ink application unit 3. With this configuration, ink of each color is applied to the transfer drum 1 which is the intermediate transfer medium in the ink application unit 3, and then the transferability improving agent is applied to the ink image 23 formed on the transfer drum 1. Since beading is prevented easily by the application of the transferability improving agent after the process liquid and the ink react to each other, the position of the transferability improving agent application unit 4 in this embodiment is desirable. However, the position of the transferability improving agent application unit 4 is not limited to that described above in the present invention. For example, the transferability improving agent application unit 4 may be disposed between the ink application unit 3 and the process liquid application unit 2, or may be disposed in the upstream of the process liquid application unit 2. The transferability improving agent application unit 4 may also be disposed in the downstream of the ink image processing unit 5 which will be described later.

3.4.2 Transferability Improving Agent

Next, the transferability improving agent applicable to the present embodiment will be described. The transferability improving agent is a material for improving transferability during the transfer of the ink (ink image 23) on the intermediate transfer medium to the printing medium 9. Transferability represents a ratio of the ink transferred to the printing medium 9 from the transfer drum 1 in the transfer unit 6.

In order to improve transferability during the transfer of the ink image 23 on the transfer drum 1 to the printing medium 9, it is effective, as described above, to apply the transferability improving agent including resin and a solvent to the ink image 23 formed on the transfer drum 1 which is the intermediate transfer medium. With this, thickness of the transferred ink image 23 is made uniform and the contact area of the ink image 23 and the surface of the printing medium 9 is increased. Thus, adhesion between the ink image 23 and the printing medium 9 is increased and thereby transferability is improved. In the present embodiment, the transferability improving agent is mainly constituted by ink composition from which the colorant (pigment or dye) is removed. However, the composition of the transferability improving agent is not limited to the same.

The transferability improving agent may include resin, such as water-soluble resin, and a water-soluble crosslinking agent which help improve transferability by increasing coatability of the ink image 23 or by increasing adhesion between the ink image 23 and the printing medium 9. Any types of water-soluble resin may be used but it is desirable to select the water-soluble resin in accordance with the types of the application unit or the printing medium 9. For example, if the transferability improving agent application unit is a recording head, the water-soluble resin desirably has the weight average molecular weight of 1,000 to 30,000 and preferably 3,000 to 15,000. If the weight average molecular weight of the water-soluble resin is below 1,000, the effect of improving coatability of the ink image and adhesion to the printing medium deteriorates. If the weight average molecular weight of the water-soluble resin is above 30,000, viscosity of the transferability improving agent is increased and thereby ejection of the ink from the inkjet head becomes difficult.

If the transferability improving agent application unit is a roller application unit, water-soluble resin with even larger weight average molecular weight may be used. Examples of the water-soluble resin include a block copolymer, a random copolymer, a graft copolymer and salts thereof constituted by at least two monomers (at least one of them is a hydrophilic polymerizable monomer) selected from the group consisting of styrene, styrene derivative, vinyl naphthalene, vinyl naphthalene derivative, aliphatic alcohol ester of $\alpha$, $\beta$-ethylenic unsaturated carboxylic acid, acrylic acid, acrylic acid derivative, maleic acid, maleic acid derivative, itaconic acid, itaconic acid derivative, fumaric acid, fumaric acid derivative, vinyl acetate, vinyl alcohol, vinyl pyrrolidone, acryl amide and derivatives thereof. Natural resins, such as rosin, shellac and starch, may also be used suitably. The above-listed resin is alkali-soluble resin, which is soluble in an aqueous solution in which a base is dissolved. If the amount of the water-soluble resin with respect to the total mass of the transferability improving agent is excessively small, the effect will not exhibited. If excessively large, on the contrary, resin may deposit when stored in some storage environments. Desirably, the water-soluble resin is included in an amount of 0.1 to 10 mass %, more preferably 0.1 to 20 mass %, with respect to the total mass of the transferability improving agent.

Examples of the pH adjusting agent used for the dissolution of the resin includes organic amines, such as diethanolamine and triethanolamine, inorganic alkaline agents of hydroxides of alkaline metal, such as sodium hydroxide, lithium hydroxide and potassium hydroxide, organic acid and mineral acid. The water-soluble resin described above is dispersed or dissolved in an aqueous liquid medium to constitute the transferability improving agent.

A suitable aqueous solvent which constitutes the transferability improving agent is a mixture solvent of water and a water-soluble organic solvent. Water is desirably ion exchange water (deionized water) rather than commonly-used water which contains various ions.

Examples of the water-soluble organic solvent used in the mixture with water include a water-soluble organic solvent commonly used for the inkjet ink. Among the water-soluble organic solvents commonly used for the inkjet ink, lower alkyl ether of polyhydric alcohol, such as polyhydric alcohol, such as diethylene glycol, and triethylene glycol monomethyl (or monoethyl)ether, is suitably used. In addition to the components mentioned above, the transferability improving agent may also include other additives, such as a surfactant, an antifoaming agent and an antiseptic agent, to provide the transferability improving agent with desired physical properties if necessary. Examples of the anionic surfactant which may be suitably added to the transferability improving agent include commonly-used carboxylate salt anionic surfactant, sulfate ester anionic surfactant, sulfonate anionic surfactant and phosphoric acid ester anionic surfactant.

3.5 Ink Image Processing Unit

Next, the ink image processing unit 5 illustrated in FIG. 1 will be described. The ink image processing unit 5 removes the solvent of the ink image 23 so as to optimize adhesion of the ink to the printing medium 9 during the transfer. In the solvent removal, solvent content including water is removed from the ink image 23, which has been formed by the process liquid application unit 2, the ink application unit 3 and the transferability improving agent application unit 4. The ink image processing unit 5 is provided with an infrared lamp 24 for the removal of the solvent in the ink, which is mainly the moisture content of the ink, through evaporation or separation. The ink image processing unit 5 is provided for the control of transferability of the ink image 23 to the printing medium 9 through consideration of permeability of the ink image 23 to the printing medium 9 and by the adjustment of the amount of heat of the infrared lamp.

Although the ink image is dried in an accelerated manner with the infrared lamp 24 in the present embodiment, other systems, such as an air knife, capable of controlling blow temperature and transferability of the ink image may also be employed. Other systems capable of removing the solvent including water in the ink may also be employed. For example, a known system which absorbs the solvent including water or a system using a squeegee blade roller which squeezes the solvent including water may be employed.

3.6 Transfer Unit 6, Paper Feeding/Conveyance Unit 11 and Printing Medium Separation Unit 7

The transfer unit 6 includes a transfer roller 26. The paper feeding/conveyance unit 11 includes conveying rollers 27*a* and 27*b* and conveyance guides 28*a* and 28*b*. In the transfer unit 6, the printing medium 9 conveyed via a guide section defined between the conveyance guides 28*a* and 28*b* as the conveying rollers 27*a* and 27*b* of the paper feeding/conveyance unit 11 rotate is pressed against the transfer drum 1 by the transfer roller 26. With such control, the ink image 23 on the transfer drum 1 is transferred to a surface of the printing medium 9.

The transfer roller 26 is, for example, a rubber roller or a metal roller and is disposed such that the printing medium 9 might pass through a nip section defined between the transfer roller 26 and the transfer drum 1. The transfer unit 6 may be provided with a press control device (not illustrated) which causes the transfer roller 26 to be pressed against and released from the transfer drum 1.

As illustrated in FIG. 1, the conveying rollers 27*a* and 27*b* rotate in the direction of arrow B and the transfer roller 26 rotates in the direction of arrow C. When being pressed against the transfer drum 1, the transfer roller 26 may be rotated following the rotation of the transfer drum 1 via the printing medium 9. Alternatively, the transfer roller 26 may be driven to rotate in a controlled manner by a separately provided transfer roller driving unit (not illustrated). In the present embodiment, the transfer roller 26 is adapted to be pressed against the transfer drum 1 with line load of 20 kg/cm via the printing medium 9 during the transfer. The line load is not limited to the same.

The printing medium separation unit 7 includes a separation claw 29 which is activated in accordance with the conveying timing of the printing medium 9. Upon completion of the above-described transfer, the separation claw 29 is driven by an unillustrated driving unit to cause the printing medium 9 to be separated from the transfer drum 1. The separation claw 29 then guides the printing medium 9 to paper discharge/conveyance/fixation unit 13 via the guide section defined between the conveyance guides 28*c* and 28*d*.

3.7 Paper Discharge/Conveyance/Fixation Unit

The paper discharge/conveyance/fixation unit 13 includes conveyance guides 28*c* and 28*d* and conveyance fixing rollers 30*a* and 30*b*. The conveyance fixing rollers 30*a* and 30*b* have a built-in infrared heater. In the paper discharge/conveyance/fixation unit 13, the printing medium 9 which has been guided between the conveyance guides 28*c* and 28*d* and has the ink image transferred thereto is heated in the conveyance fixing rollers 30*a* and 30*b*. With the heat, the transferred image is fixed to the printing medium 9. The paper discharge/conveyance/fixation unit 13 then feeds the printing medium 9 to an unillustrated discharge tray by the rotation of the rollers. In this manner, recording to the printing medium 9 is completed. The conveyance fixing rollers 30*a* and 30*b* may be formed by well-known fixing rollers. The heating temperature of the conveyance fixing rollers 30*a* and 30*b* is desirably about 30 to 200 degrees C. If the heating temperature is below 30 degrees C., no effects will be exhibited due to small changes in the physical property of the ink image. If the heating temperature is above 200 degrees C. on the other hand, adverse effects, such as a change of shape in the printing medium, may be caused. The rollers may be made of, for example, metal and silicone rubber. Silicone oil or other materials may be applied to the roller surfaces in order to improve removability of the printing medium 9.

3.8 Cleaning Unit

The cleaning unit 8 includes a cleaning liquid holding member 31, a cleaning liquid feed roller 32*a* and a cleaning roller 32*b*. The cleaning liquid holding member 31 holds the cleaning liquid 33. The cleaning roller 32*b* rotates in contact with the transfer drum 1 to thereby apply the cleaning liquid 33 and remove debris from the transfer drum 1. The cleaning liquid feed roller 32*a* is disposed between the cleaning liquid holding member 31 and the cleaning roller 32*b* and supplies the cleaning liquid 33 to the cleaning roller 32*b* from the cleaning liquid holding member 31.

The cleaning roller 32*b* may be rotated following the rotation of the transfer drum 1 or may be driven to rotate in a controlled manner by an unillustrated driving unit. The cleaning liquid feed roller 32*a* may be rotated following the rotation of the cleaning roller 32*b* or may be driven to rotate in a controlled manner by an unillustrated driving unit. In either case, as the cleaning liquid feed roller 32*a* and the cleaning roller 32*b* rotate, the cleaning liquid 33 is applied to the transfer drum 1 via these rollers and the transfer drum 1 is cleaned.

The configuration of the cleaning unit 8 is not limited to that illustrated in FIG. 1. Any configurations capable of suitably cleaning the surface of the transfer drum 1 may be adopted. The type of the cleaning liquid 33 is not especially limited but aqueous solutions including, for example, the surfactant and the water-soluble organic solvent used in the above-described process liquid may be employed suitably. As in the transfer unit 6, the cleaning roller 32*b* may be provided with a press control device (not illustrated) which causes the cleaning roller 32*b* to be pressed against and released from the transfer drum 1.

4. Recording Procedure

Figure 7:
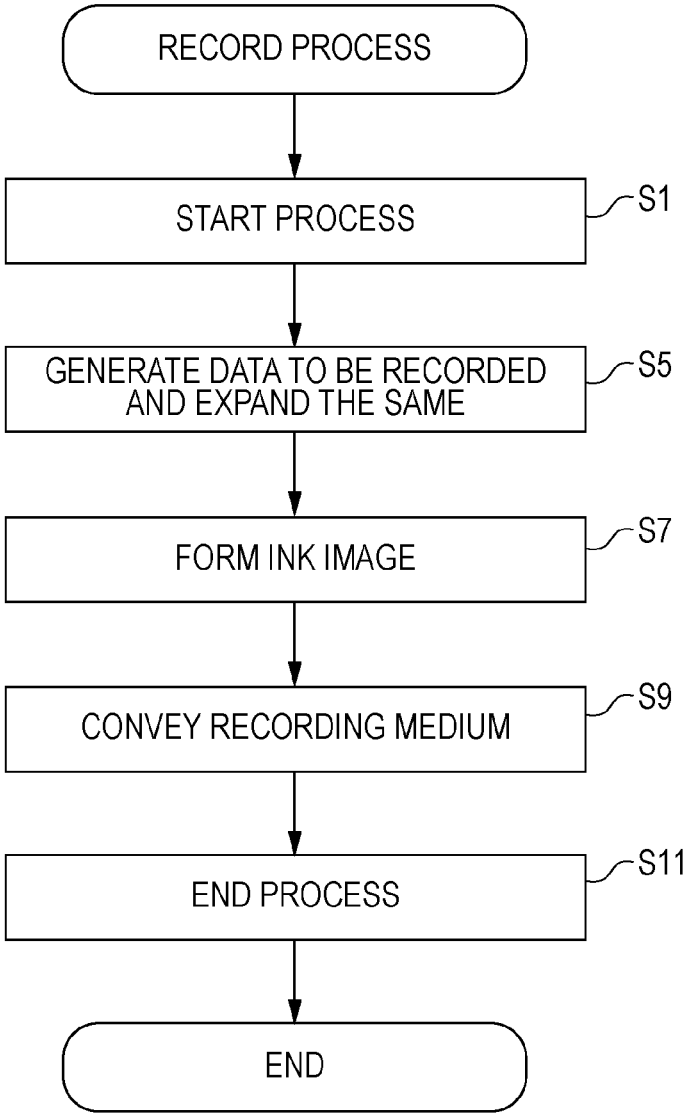
FIG. 7 is a flowchart illustrating a recording process.

A series of recording operations of the inkjet recording device will be described. FIG. 7 is a flowchart illustrating a recording procedure on the inkjet recording device illustrated in FIGS. 1 and 6.

Upon reception of the input of a recording start instruction, the inkjet recording device performs a start process (step S1). The start process may include the following operations: driving the transfer drum 1 to rotate; and turning on the heaters in the transfer drum 1, the infrared lamp 24 and the conveyance fixing rollers 30*a* and 30*b* to set and adjust temperature of each section to predetermined temperature. Position of each section of the printing medium conveyance system is controlled if necessary. If it is desirable to clean the surface of the transfer drum 1 before starting the later-described image formation operation, the cleaning roller 32*b* may be pressed against the transfer drum 1 for the application of the cleaning liquid and cleaning of the transfer drum 1. The start process also includes feeding the printing medium 9 from a paper feed tray 10 to the paper feeding/conveyance unit 11.

Next, the inkjet recording device receives image data from the image supply device 110, which may be a computer. The inkjet recording device generates the ink application data using the received image data in a first generation step as described above. In a second generation step, the transferability improving agent application data is generated using the ink application data. The application data is stored in the memory (step S5). The application roller 20*b* is then pressed against the transfer drum 1. As the application roller 20*a* rotates, the process liquid 19 is applied to the application roller 20*b* via the application roller 20*a*. In this manner, the process liquid 19 is uniformly applied to the transfer drum 1. Then, the recording head 21 (21*a*, 21*b*, 21*c* and 21*d*) is driven to eject the ink of each color in accordance with the ink application data described above toward the transfer drum 1 which is being driven to rotate. Thus, the ink image 23 (which is a mirror image of the image finally recorded on the printing medium 9) is formed on the transfer drum 1 to which the process liquid has been applied (step S7).

At this time, since the ink applied by the recording head 21 to the transfer drum 1 and the process liquid previously applied by the process liquid application unit 2 aggregate together, an image of aggregation ink is formed on the transfer drum 1. With this, a high quality image without beading or bleeding is formed on the transfer drum.

Next, in accordance with the transferability improving agent application data described above, the transferability improving agent is applied from the head 22 for applying the transferability improving agent to the ink image 23 which is the image of aggregated ink formed on the transfer drum 1. In this manner, difference in height of the ink image is reduced and thereby thickness of the ink image is controlled suitably for the printing medium used. The solvent including moisture content in the ink image is then dried through evaporation by the ink image processing unit 5. The ink image is now in the optimum state for the subsequent transfer operation.

Then, the printing medium 9 is conveyed while being aligned with the ink image 23 formed on the transfer drum 1 (step S9). In particular, the printing medium 9 is conveyed by the conveying rollers 27*a* and 27*b* toward the transfer unit 6 such that a leading end of the ink image 23 formed on the transfer drum 1 and the printing medium 9 might overlap at the nip section which is the transfer position as described above. Thus, in the transfer unit 6, the ink image on the transfer drum 1 is transferred to the printing medium 9. Upon detection of the separation of the leading end of the printing medium 9 from the transfer unit 6 with an unillustrated sensor, the separation claw 29 is inserted between the transfer drum 1 and the printing medium 9 to separate the printing medium 9 from the transfer drum 1. The printing medium 9 separated from the transfer drum 1 is made to pass through the conveyance guides 28*c* and 28*d*, heated by the conveyance fixing rollers 30*a* and 30*b* for the fixation and then guided to the discharge tray.

Upon completion of the recording operations on the printing medium 9, i.e., after the ink image is formed, the printing medium is conveyed and the ink image is transferred, an end process is performed (step S11). In particular, the transfer roller 26 and the separation claw 29 are separated from the transfer drum 1. The cleaning roller 32*b* is pressed against the transfer drum 1 to clean the surface of the transfer drum 1 while applying the cleaning liquid 33. As the transfer drum 1 rotates 360 degrees, the cleaning roller 32*b* is separated from the transfer drum 1. If the recording is continued to subsequent printing media, formation of the ink image, conveyance of the printing medium and transfer of the ink image in accordance with the image data will be repeated.

EXAMPLES

Hereinafter, Examples using the above-described exemplary process liquid, ink and transferability improving agent will be described in detail.

Example 1

In the description below, "parts" and "%" are parts by mass and % by mass unless otherwise stated. Water was added to each of the ink, the process liquid and the transferability improving agent such that the total amount thereof might be 100 parts.

Preparation of Pigment Ink

As will be described below, pigment ink of each color of black, cyan, magenta and yellow each including pigment and an anionic compound is prepared first.

Preparation of Pigment Ink K1

Preparation of Pigment Dispersion Liquid

| | |
|---|---|
| Copolymer of styrene acrylic acid and ethyl acrylate (acid value: 240; weight average molecular weight: 5,000) | 1.5 parts |
| Monoethanolamine | 1.0 part |
| Diethylene glycol | 5.0 parts |
| Ion exchange water | Remainder |

These components are mixed and heated to 70 degrees C. in a water bath to have resin content dissolved completely. To this solution, 10 parts of newly prepared Carbon Black (MCF88 manufactured by Mitsubishi Chemical Corporation) and 1 part of isopropyl alcohol are added. The obtained solution is premixed for 30 minutes and subject to dispersion under the following conditions.

| | |
|---|---|
| Disperser: | sand grinder (manufactured by Aimex Co., Ltd.) |
| Grinding medium: | 1-mm diameter zirconium bead |
| Filling rate of grinding medium: | 50% (volume ratio) |
| Grinding time: | 3 hours |

The obtained solution is subject to centrifugal separation (12,000 rpm, 20 minutes) to remove coarse particles. In this manner, a black pigment dispersion liquid is obtained.

Preparation of Ink

Components in the following composition ratio are mixed into the above obtained pigment dispersion liquid to prepare pigment-containing ink, which is black pigment ink K1. Surface tension of the obtained ink is 34 mN/m.

| | |
|---|---|
| The above-described pigment dispersion liquid | 30.0 parts |
| Glycerin | 10.0 parts |
| Ethylene glycol | 5.0 parts |
| 2-pyrrolidone | 5.0 parts |
| Acetylenol EH (manufactured by Kawaken Fine Chemicals Co., Ltd.) | 1.0 part |
| Ion exchange water | Remainder |

Preparation of Pigment Ink C1

Cyan pigment ink C1 is prepared in the same manner as in the preparation of pigment ink K1 except that 10 parts of Pigment Blue 15 is used in place of Carbon Black (MCF88 manufactured by Mitsubishi Chemical Corporation).

Preparation of Pigment Ink M1

Magenta pigment ink M1 is prepared in the same manner as in the preparation of pigment ink K1 except that 10 parts of Pigment Red 7 is used in place of Carbon Black (MCF88 manufactured by Mitsubishi Chemical Corporation).

Preparation of Pigment Ink Y1

Yellow pigment ink Y1 is prepared in the same manner as in the preparation of pigment ink K1 except that 10 parts of Pigment Yellow 74 is used in place of Carbon Black (MCF88 manufactured by Mitsubishi Chemical Corporation).

Preparation of Process Liquid

Next, as will be described below, process liquids each having polyvalent metal salt and a surfactant are prepared.

Preparation of Process Liquid R1

The components of the following composition are mixed together and dissolved, and then filtered under pressure with a membrane filter (trade name: Fluoropore filter manufactured by Sumitomo Electric Industries, Ltd) having pore size of 0.22 micrometers. In this manner, process liquid R1 is obtained.

| | |
|---|---|
| Diethylene glycol | 10.0 parts |
| Calcium chloride 2-hydrate | 10.0 parts |
| Acetylenol EH (manufactured by Kawaken Fine Chemicals Co., Ltd.) | 0.5 parts |
| Ion exchange water | Remainder |

Preparation of Transferability Improving Agent

Next, as will be described below, the transferability improving agents each having resin and a surfactant are prepared. The obtained transferability improving agent is a transparent liquid.

Preparation of Transferability Improving Agent T1

Components in the following composition ratio are mixed to prepare transferability improving agent T1.

| | |
|---|---|
| Hexylene glycol | 10.0 parts |
| Ethylene glycol | 5.0 parts |
| 2-pyrrolidone | 5.0 parts |
| Polyvinylpyrrolidone (K-15; Molecular weight: 10000) | 5.0 parts |
| Acetylenol EH (manufactured by Kawaken Fine Chemicals Co., Ltd.) | 0.5 parts |
| Ion exchange water | Remainder |

An image is formed using the thus-prepared process liquid R1, pigment ink K1, C1, M1 and Y1 and transferability improving agent T1. A sheet of Aurora Coat (registered trademark) manufactured by Nippon Paper Industries is used as the printing medium.

In the present embodiment, recording density of the image recorded by the recording head 21 for ejecting color ink and by the head 22 for applying the transferability improving agent is 1,200 dpi and the heads are driven at a driving frequency of 10 kHz. An ejection amount of each ejection event is 4 pl. The rotational speed of an outer periphery of the transfer drum is 100 mm/second.

First, process liquid R1 is applied to the transfer drum 1 to about 1 micrometer in thickness in the process liquid application unit 2. Then, in accordance with the ink application data corresponding to ink of each color, pigment ink Y1, M1, C1 and K1 are applied sequentially from the inkjet head 21 to form the ink image 23 on the transfer drum 1. Visual observation reveals that the ink image 23 formed on the transfer drum 1 is good without beading or bleeding.

Next, in accordance with the transferability improving agent application data, the transferability improving agent is applied from the transferability improving agent application unit 4 to the ink image 23 formed on the transfer drum 1. The transferability improving agent application data is generated in the following manner. First, integration data is generated by the integration of the binary ink application data of four colors corresponding to the ink of CMYK for each pixel. Here, since the maximum number of droplets that can be applied to each pixel is four (each one droplet for the colors of CMYK), the integration data is a value of 0 to 4. Then, for each pixel, a value representing the integration data is subtracted from a target value of the total of the ink and the transferability improving agent to be applied to the pixel. Thus, a subtraction value is obtained. The subtraction value is used as the transferability improving agent application data of each pixel. Here, the target value is set to 5. Thus, the value represented by the transferability improving agent data is any of 1 to 5.

Granularity of the image to which the transferability improving agent is applied in accordance with the transferability improving agent application data is measured with laser microscopy VK9710 manufactured by KEYENCE CORPORATION. It is confirmed that thickness of the ink image is uniform regardless of the application amount of the ink over the surface of the ink image.

The ink image 23 on the transfer drum 1 is dried by the infrared lamp 24 included in the ink image processing unit 5 and thereby the moisture content which is the main solvent of the ink image 23 evaporates. Then, in the transfer unit 6, the ink image 23 on the transfer drum 1 is transferred to the printing medium 9 which is fed by the conveying rollers 27*a* and 27*b*. The transferred ink image 23 has been controlled to have suitable thickness for the printing medium 9. It is confirmed that there is no ink residue on the transfer drum 1 after the ink image 23 is transferred. Pressure applied for the transfer is 20 kg/cm$^2$.

The ink image is fixed to the printing medium as the printing medium having the ink image transferred thereto is made to pass through the conveyance fixing rollers 30*a* and 30*b* at heating temperature of 150 degrees C. The finally obtained color image is observed with an optical microscope at 100-fold magnification and it is confirmed that no blank or distortion has occurred in the image. This means that the ink image 23 has been transferred from the transfer drum 1 substantially completely to the printing medium 9. There is no ink residue on the transfer drum 1 and the surface is easy to clean. After the above-described procedure is repeated for the formation of images, high quality images can still be obtained continuously.

Example 2

Example 2 is the same as Example 1 except for the method of generating the transferability improving agent application data. Thus, only the difference with Example 1 will be described below.

Integration data is obtained by the integration for each pixel of the ink application data for each color. The maximum value (i.e., the data value representing the largest application amount of the ink) is specified from among the integration data. Then, for each pixel, the integration data value is subtracted from the above-described maximum value such that the total of the application amounts of the ink and the transferability improving agent might be the same as the application amount of the ink corresponding to the above-described maximum value. The obtained subtraction value is used as the transferability improving agent application data. In accordance with the transferability improving agent application data, the transferability improving agent is applied to the ink image and the transfer image is obtained. Granularity of the transferred image is measured at 50-fold magnification with laser microscopy VK9710 manufactured by KEYENCE CORPORATION. It is confirmed that thickness of the ink image is uniform regardless of the application amount of the ink.

Comparative Example 1

An image is formed in the same manner as in Example 1 except that no transferability improving agent T1 is used.

Transferability is obtained to be 99.7% by dividing an area of the ink image transferred to the printing medium 9 by an area of the ink image area formed on the transfer drum. Visual observation reveals that there is an ink residue on the transfer drum 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-285772 filed Dec. 16, 2009, which is hereby incorporated by reference herein in its entirety.

What is claimed is:

1. An inkjet recording method, comprising:

forming an image by applying ink and a transferability improving agent to an intermediate transfer medium, the transferability improving agent improving transferability of the ink applied to the intermediate transfer medium, wherein the transferability improving agent comprises resin; and transferring the image formed on the intermediate transfer medium to a printing medium, wherein, in the step of forming the image, the transferability improving agent is applied in a larger amount to regions with a relatively small application amount of the ink per unit area as compared with regions with a relatively large application amount of the ink per unit area.

2. The method according to claim 1, further comprising:

generating ink application data for the application of the ink; and generating, in accordance with the ink application data, transferability improving agent application data for the application of the transferability improving agent such that the transferability improving agent might be in a larger amount to regions with a relatively small application amount of the ink per unit area as compared with regions with a relatively large application amount of the ink per unit area, wherein the ink is applied in accordance with the ink application data and the transferability improving agent is applied in accordance with the transferability improving agent application data.

3. The method according to claim 1, wherein the ink is applied to the intermediate transfer medium before the transferability improving agent is applied to the intermediate transfer medium.

4. An inkjet recording method, comprising:

forming an image by applying ink and a transferability improving agent to an intermediate transfer medium, the transferability improving agent improving transferability of the ink applied to the intermediate transfer medium, wherein the transferability improving agent comprises resin; and transferring the image formed on the intermediate transfer medium to a printing medium, wherein, in the step of forming the image, the transferability improving agent is applied in accordance with an application amount determined in accordance with the application amount of the ink per unit area such that the total of the application amounts of the ink and the transferability improving agent per unit area might be constant.

5. The method according to claim 4, further comprising:

generating ink application data used for the application of the ink; and generating, in accordance with the ink application data, transferability improving agent application data for the application of the transferability improving agent such that the total of the application amounts of the ink and the transferability improving agent per unit area might be constant, wherein the ink is applied in accordance with the ink application data and the transferability improving agent is applied in accordance with the transferability improving agent application data.

6. The method according to claim 4, wherein the ink is applied to the intermediate transfer medium before the transferability improving agent is applied to the intermediate transfer medium.

7. An image forming apparatus, comprising:

an inkjet head which applies ink to an intermediate transfer medium;

a transferability improving agent application unit which applies a transferability improving agent for the improvement of transferability of the ink applied to the intermediate transfer medium, wherein the transferability improving agent comprises resin;

a transfer unit which transfers, to a printing medium, an image formed by the ink applied by the inkjet head and the transferability improving agent applied by the transferability improving agent application unit; and a controlling unit which controls an application amount of the transferability improving agent such that the transferability improving agent might be in a larger amount to regions with a relatively small application amount of the ink per unit area as compared with regions with a relatively large application amount of the ink per unit area.

8. An image forming apparatus, comprising:

an inkjet head which applies ink to an intermediate transfer medium;

a transferability improving agent application unit which applies a transferability improving agent for the improvement of transferability of the ink applied to the intermediate transfer medium, wherein the transferability improving agent comprises resin;

a transfer unit which transfers, to a printing medium, an image formed by the ink applied by the inkjet head and the transferability improving agent applied by the transferability improving agent application unit; and a controlling unit which controls, in accordance with the application amount of the ink per unit area, an application amount of the transferability improving agent such that the total of the application amounts of the ink and the transferability improving agent per unit area might be constant.

9. An inkjet recording method, comprising:

forming an image by applying ink and a liquid comprising resin to an intermediate transfer medium; and transferring the image formed on the intermediate transfer medium to a printing medium, wherein, in the step of forming the image, the liquid comprising resin is applied in a larger amount to regions with a relatively small application amount of the ink per unit area as compared with regions with a relatively large application amount of the ink per unit area.

10. An inkjet recording method, comprising:

forming an image by applying ink and a liquid comprising resin to an intermediate transfer medium; and transferring the image formed on the intermediate transfer medium to a printing medium, wherein, in the step of forming the image, the liquid comprising resin is applied in accordance with an application amount determined in accordance with the application amount of the ink per unit area such that the total of the application amounts of the ink and the liquid comprising resin per unit area might be constant.

* * * * *